US009028705B2

(12) United States Patent
Wei et al.

(10) Patent No.: US 9,028,705 B2
(45) Date of Patent: May 12, 2015

(54) CAPSULE

(75) Inventors: Zhao Wei, Singapore (SG); Han Zhisan, Singapore (SG); David Miller, Singapore (SG)

(73) Assignee: Magnequench Limited, Bridgetown (BB)

( * ) Notice: Subject to any disclaimer, the term of this patent is extended or adjusted under 35 U.S.C. 154(b) by 0 days.

(21) Appl. No.: 13/701,357

(22) PCT Filed: May 31, 2012

(86) PCT No.: PCT/SG2012/000192

§ 371 (c)(1),
(2), (4) Date: Mar. 6, 2013

(87) PCT Pub. No.: WO2012/166054

PCT Pub. Date: Dec. 6, 2012

(65) Prior Publication Data

US 2014/0151594 A1 Jun. 5, 2014

(30) Foreign Application Priority Data

Jun. 2, 2011 (GB) ..... 1109252.5

(51) Int. Cl.

| | |
|---|---|
| ***H01F 41/00*** | (2006.01) |
| ***H01F 7/02*** | (2006.01) |
| ***H01F 1/047*** | (2006.01) |
| ***H01F 1/06*** | (2006.01) |
| ***H01F 1/08*** | (2006.01) |
| ***H01F 1/44*** | (2006.01) |

(52) U.S. Cl.

CPC ..... *H01F 1/061* (2013.01); *C22C 2202/02* (2013.01); *H01F 1/08* (2013.01)

(58) Field of Classification Search

USPC ..... 252/62.51 R, 62.55, 62.56, 62.57, 252/62.51 C; 428/402.24; 427/212, 213.3; 264/4.1, 4.3

See application file for complete search history.

(56) References Cited

U.S. PATENT DOCUMENTS

| | | | | |
|---|---|---|---|---|
| 3,041,289 | A | 6/1962 | Katchen et al. | |
| 4,565,764 | A | 1/1986 | Nakahara et al. | |
| 5,571,651 | A | 11/1996 | Inaba et al. | |
| 6,413,548 | B1 * | 7/2002 | Hamer et al. | 424/489 |
| 2007/0231389 | A1 | 10/2007 | Bunick et al. | |

OTHER PUBLICATIONS

Cassie, "Contact Angles", Discussions of the Faraday Society, I1-I5, Jan. 27, 1948.

Wenzel, "Resistance of Solid Surfaces to Wetting by Water", Industrial and Engineering Chemistry, vol. 28, No. 8, Mar. 27, 1996.

Asthana, et al., "Wettability, Spreading, and Interfacial Phenomena in High-Temperature Coatings", The Minerals, Metals & Materials Society, JOM-e, 52 (1), 2000.

Kim, et al., Synthesis of Nanorattles Composed of Gold Nanoparticles Encapsulated in Mesoporous Carbon and Polymer Shells, Nano Letters, vol. 2, No. 12, pp. 1383-1387, 2002.

(Continued)

*Primary Examiner* — Carol M Koslow

(74) *Attorney, Agent, or Firm* — Brinks Gilson & Lione

(57) ABSTRACT

A capsule having a solid core, a primary shell of liquid encapsulating the solid core and a secondary shell of particles encapsulating the primary shell. The primary and secondary shells are generally repulsive to each other. Also provided is a process for the manufacture of capsules and a process for the manufacture of a magnetic body.

20 Claims, 2 Drawing Sheets

(56) References Cited

OTHER PUBLICATIONS

Erokhina, et al, "Patterned Arrays of Magnetic Nano-Engineered Capsules on Solid Supports", Journal of Magnetism and Magnetic Materials, vols. 272-276, pp. 1353-1354, 2004.

Australian Patent Office, International Search Report and Written Opinion of PCT/SG2012/000192, Jul. 20, 2012.

* cited by examiner

CAPSULE

CROSS-REFERENCE TO RELATED APPLICATIONS

The present application is a national stage application under 35 U.S.C. §371 of PCT/SG2012/000192, filed May 31, 2012, which claims priority to UK Patent Application No. 1109252.5, filed Jun. 2, 2011, which applications are incorporated herein by reference and made a part hereof in their entirety, and the benefit of priority of each of which is claimed herein.

BACKGROUND OF THE INVENTION

1. Field of the Invention

The present invention relates to a capsule and a process for the manufacture of the same. The present invention also relates to the use of a mass of the capsules in the manufacture of a magnetic body.

2. Description of the Related Art

The manufacture of permanent magnets using rare earth metal-based magnetic material particles is known. The manufacturing process involves shaping the magnetic material particles into a pre-fixed shape wherein the particles are held together by a polymer or the like. However, rare earth polymer-bonded magnets tend to experience durability issues especially due to the poor tolerance of the particles to oxidation at high temperatures which in turn, shortens the magnetic life-span of the magnets produced. In addition, the magnetic properties of the particles and therefore the magnetic body will be severely degraded with rapid oxidation of the magnet in air over time. Oxidation also occurs during the magnet manufacturing process which raises safety issues of this process.

To limit the durability problems caused by oxidation, the fabrication process of magnets may occur in static or non-oxidising surroundings or may involve a pre-compaction heat step to stop the particles from coming into contact with air.

In a known process, a magnetic body made of rare earth magnetic particles comes into contact with a mobile phase containing an anti-oxidant during or after the compaction step possibly via immersion of the magnetic particles in the said mobile phase. This approach has been found to minimise oxidation of the magnetic particles in the magnet manufacturing process by coating the surfaces of the magnetic particles that form the magnetic body with a protective layer. Although this may protect freshly exposed surfaces of the magnetic particles from oxidation at the time of or after compaction, it can be difficult to get all of the anti-oxidant to be evenly dispersed throughout the body of the magnet and thereby for the anti-oxidant to contact microfactures that may form in the magnetic particles during the compaction step. Microfractures in the particles may increase the susceptibility of particles to air and hence oxidation, especially when the liquid containing the anti-oxidant is unable to efficiently flow into the microfractures and coat the exposed surfaces within. Thus, the effectiveness of the exposure of the magnetic particles to the anti-oxidant during or after compaction step to minimise oxidation is reduced. As a result, a magnet made from the magnetic particles containing microfractures which have not been efficiently coated during or after the manufacturing process, may be susceptible to oxidation, which leads to a loss in its magnetic properties.

Accordingly, the challenge of preventing oxidation within the magnet at reasonable cost without comprising productivity and effectiveness remains. Given that oxidation problems exist in current magnetic manufacturing techniques, there is a need to improve the methods and materials used early on and throughout the magnet manufacturing process that overcome, or at least ameliorate, one or more of the disadvantages described above.

There is also a need to increase the contact surface area of the magnetic particles with the anti-oxidant during the manufacture of a magnetic body.

BRIEF SUMMARY OF THE INVENTION

According to a first aspect, there is provided a capsule comprising a solid core, a primary shell of liquid encapsulating the solid core and a secondary shell of particles encapsulating the primary shell, wherein the primary and secondary shells are generally repulsive to each other.

Advantageously, the repulsion between the primary and secondary shells supports the formation of a capsule as it allows the particles in the secondary shell to be supported and retained on the surface of the liquid. The particles in the secondary shell may align themselves to substantially cover the surface of the primary shell and thereby encapsulate the primary shell. The primary shell of liquid may be substantially encapsulated such that the capsule surface remains dry. This allows the capsule to maintain flowability and prevents agglomeration of the particles. More advantageously, the disclosed capsule is more resistant to external pressure in that the capsules may be handled as solid particles without rupture of the secondary shell to release the liquid primary shell, without at least a significant pressure being applied to the secondary shell. Accordingly the capsules can be easily transported without rupture of the secondary shell and release of the primary liquid shell. However, if the capsules are subjected to a significant compressive force, such as during a compressive molding step, the secondary shell may rupture and release the primary liquid shell.

According to a second aspect, there is provided a process for the manufacture of capsules comprising the steps of providing a first population of solid core particles and a second population of fine particles that are smaller than the solid core particles of the first population; and mixing a liquid with the first population and the second population to thereby form capsules which comprise the solid core, a primary shell of the liquid encapsulating the solid core and a secondary shell of the fine particles encapsulating the primary shell, wherein the primary and secondary shells are generally repulsive to each other.

Advantageously, the disclosed process provides for uniform distribution of the primary shell of liquid over the surface of the core particles and the uniform distribution of the secondary shell of particles over the surface of said liquid. Additionally, the disclosed process may be used to fabricate different types of capsules that may be used for containing a wide variety of liquid and particles. More advantageously, the liquid in the disclosed process does not necessarily have to be sprayed onto the solid core particles or atomized before mixing with the solid core particles. Hence, the disclosed method significantly broadens the variety of liquid that could be used.

According to a third aspect, there is provided a process for the manufacture of a magnetic body, the process comprising the step of compacting a mass of capsules to form the magnetic body, each capsule comprising a solid magnetic core, a primary shell of liquid encapsulating the solid core that comprises an anti-oxidant agent therein that inhibits or prevents oxidation of the magnetic core, and a secondary shell of particles encapsulating the primary shell, wherein one of the primary shell or secondary shell is hydrophobic while the other of the respective primary shell or secondary is hydrophilic, and wherein said compacting ruptures said secondary shell to release the liquid of the primary shell.

Advantageously, the incorporation of a primary she of liquid comprising an anti-oxidant agent provides a means to passivate and prevent corrosive and oxidative tendencies by reducing the reactivity of the surfaces of the core or by decreasing the permeation of oxygen molecules to the surfaces of the cores. The disclosed process provides for the uniform distribution of the primary shell of liquid comprising the anti-oxidant over the surface of the magnetic core and thereby allows the anti-oxidant to effectively flow into the microfractures of the magnetic core particles that agglomerate to form the magnetic body during compaction. The anti-oxidant coats the exposed surfaces within the body of the magnetic core. Advantageously, this leads to a uniform distribution of a protective oxidative layer over both the surface of each magnetic core and the newly created surfaces including localised spots contained within the microfractures of the magnetic core. In addition, the magnetic body formed from the disclosed process may not succumb to oxidation even at high temperatures and hence may not be in need of further anti-oxidative treatments. In one embodiment where the particles are comprised of a magnetic material, the magnetic strength of the magnetic body may be enhanced.

The following words and terms used herein shall have the meaning indicated:

The term "repulsive" with reference to the primary and secondary shells means that the molecules from which the primary and secondary shells are respectively composed have a contact angle between the molecules equal to or greater than 90 degrees. For example, one of the primary and secondary shells may be generally hydrophobic while the other is generally hydrophilic so that the molecules of which they are respectively composed have a contact angle equal to or greater than 90 degrees. For example, if the secondary shell is hydrophobic and comprises non-polar molecules while the primary shell is hydrophilic and comprises hydrophilic molecules, the molecules of the secondary and primary shells will have a contact angle equal to or greater than 90 degrees.

The terms "liquidphobic" and "liquidphobicity" as used in the context of the present specification, are to be interpreted broadly to include any property of a surface that does not cause a liquid droplet to substantially spread across it. Generally, if the contact angle between a liquid droplet and the surface is equal to or greater than 90°, the surface is liquidphobic or exhibits liquidphobicity.

The term "hydrophobic" as used in the context of the present specification, refers to any material that is resistant to wetting, or not readily wet, by water. That is, a material that has a lack of affinity for water. A hydrophobic material typically will have a water contact angle approximately equal to or greater than 90 degrees.

The term "hydrophilic" as used in the context of the present specification, refers to any material that is prone to wetting, or readily wet, by water. That is, a material that has an affinity for water. This is to be interpreted broadly to include any material that causes a water droplet to substantially spread across the surface of the material. A hydrophilic material typically will have a water contact angle smaller than 90 degrees.

The term "wetting property" when applied to a surface is to be interpreted broadly to include any property of a surface that allows or disallows the spreading of a test liquid droplet on the surface. This spreading of a test liquid droplet depends on the roughness and surface energy. Wetting property of a surface can be determined by measuring the contact angle between the liquid droplet and the solid surface. Depending on the values of the contact angles and the directions of measurement, isotropic or anisotropic wetting property of a surface can be interpreted as liquidphobic or liquidphilic. Generally, the spreading and hence wetting behaviour of a liquid droplet can be modeled according to the Wenzel equation (see "*Resistance of Solid Surfaces to Wetting by Water*" by R. N. Wenzel, *Industrial and Engineering Chemistry,* 1936, 28 (8), page 988)) or the Cassie equation (see "Contact Angle" by A. B. D. Cassie, *Discussions of the Faraday Society,* 1948, 3, page 11). However, in some cases, the behaviour may be modeled according to a modified form(s) of the equation (s), which are known to those skilled in the art.

The term "contact angle", in the context of this specification, is to be interpreted broadly to include any angle that is measured between a liquid/solid interface. The contact angle is system specific and depends on the interfacial surface tension of the liquid/solid interface. A discussion on contact angle and its relation to surface wetting properties can be seen from "*Wettability, Spreading, and Interfacial Phenomena in High-Temperature Coatings*" by R. Asthana and N. Sobczak, *JOM-e,* 2000, 52 (1). The contact angle can be measured from two directions. In the context of this specification, for a longitudinal imprint being disposed about a longitudinal axis, $\theta x$ refers to the contact angle measured in the "X" direction being perpendicular to the longitudinal axis and $\theta y$ refers to the contact angle measured in the "Y" direction parallel, or in alignment with, the longitudinal axis. The value of the contact angle, $\theta x$ or $\theta y$, may indicate the liquidphobicity or liquidphilicity of a surface. The difference of these two contact angles, represented by $\Delta\theta$ (where $\Delta\theta=\theta y-\theta x$), indicates the degree of isotropy or anisotropy of a wetting property.

The terms "passivate", "passivating", "passivated" and grammatical variations thereof refer, in the context of this specification, to the anti-oxidant properties of a surface of a material particle after exposure to an anti-oxidant. That is, the terms refer to the surface properties of a material particle which exhibit higher resistance to oxidation compared to the surface of a material particle which has not been exposed to the anti-oxidant.

The term "in-situ passivation" in the context of this specification refers to passivation of the surfaces of a mass of material being compacted during formation of a body composed of the material but not after formation of the material.

The term "compression molding" in the context of this specification refers to a method of molding in which the material particles are first placed in an open, heated mold cavity followed by application of pressure and optionally heat until the particles have cured.

The term "compact" or "compaction" in the context of this specification refers to the compression molding, injection molding or extrusion molding process undergone by the magnetic material particles.

The word "substantially" does not exclude "completely" e.g. a composition which is "substantially free" from Y may be completely free from Y. Where necessary, the word "substantially" may be omitted from the definition of the invention.

Unless specified otherwise, the terms "comprising" and "comprise", and grammatical variants thereof, are intended to represent "open" or "inclusive" language such that they include recited elements but also permit inclusion of additional, unrecited elements.

As used herein, the term "about", in the context of concentrations of components of the formulations, typically means +/−5% of the stated value, more typically +/−4% of the stated value, more typically +/−3% of the stated value, more typically, +/−2% of the stated value, even more typically +/−1% of the stated value, and even more typically +/−0.5% of the stated value.

Throughout this disclosure, certain embodiments may be disclosed in a range format. It should be understood that the description in range format is merely for convenience and brevity and should not be construed as an inflexible limitation on the scope of the disclosed ranges. Accordingly, the description of a range should be considered to have specifically disclosed all the possible sub-ranges as well as individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Certain embodiments may also be described broadly and generically herein. Each of the narrower species and subgeneric groupings falling within the generic disclosure also form part of the disclosure. This includes the generic description of the embodiments with a proviso or negative limitation removing any subject matter from the genus, regardless of whether or not the excised material is specifically recited herein.

BRIEF DESCRIPTION OF THE SEVERAL VIEWS OF THE DRAWINGS

The accompanying drawings illustrate a disclosed embodiment and serves to explain the principles of the disclosed embodiment. It is to be understood, however, that the drawings are designed for purposes of illustration only, and not as a definition of the limits of the invention.

DETAILED DESCRIPTION OF THE INVENTION

Figure 1:
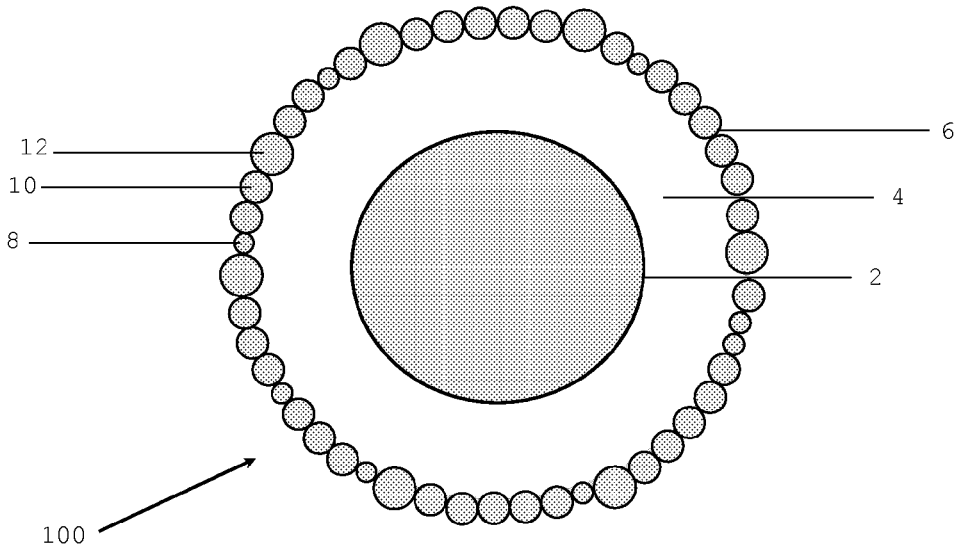
FIG. 1 is a schematic diagram of a capsule having a solid core, a primary shell of liquid and a secondary shell of particles.

Exemplary, non-limiting embodiments of the porous membrane body will now be disclosed.

The secondary shell may be liquidphobic so that said primary and secondary shells are generally repulsive to each other. Due to the different liquidphobicity between the primary shell of liquid and the secondary shell of particles, the secondary shell of particles is being pushed or repelled away from the primary shell of liquid. In one preferred embodiment, the primary shell is hydrophilic and the secondary shell is hydrophobic. When the liquid of primary shell is water, the particles of the secondary shell are hydrophobic to enable the particles being supported and retained on the surface of the water. When the liquid of primary shell is oil, the particles of the secondary shell are oleophobic to enable the particles being supported and retained on the surface of the oil.

Without being bound by theory, it is believed that the hydrophobic particles may be supported by the surface tension of the liquid medium, with no bonding between adjacent particles being necessary to support an encapsulated structure. The rigidity of the encapsulation may be adjusted by a number of means including, but not limited to, control of the bonding of the particles around the primary shell of liquid, relative hydrophobicity of the particles and the liquid, surface tension of the liquid, viscosity of the liquid, the polarity/non-polarity of the liquid and the particles, electrostatic charging of the liquid and the particles. The primary shell and secondary shell may overlap with each other such that the particles of the secondary shell extend into the liquid of the primary shell. The primary shell and secondary shell may be configured such that the primary shell and secondary shell do not overlap with each other.

The particles of the secondary shell may be configured such that said particles are in abutting relationship with each other. Each particle abut an adjacent particle with the surface of said particle in contact with the surface of said adjacent particle. The particles may be substantially bonded to each other or partially bonded to each other. The particles may have little or no physical attraction or bonding between each other.

The particles in the secondary shell may align themselves to substantially cover the surface of the primary shell. The entrapping particles may not necessarily pack in perfectly organized diameters over the surface of the primary shell, but may allow for some spacing between said particles and, allow for some stacking of said particles. There may be partial or complete layers of particles on the surface of the primary shell. The secondary shell may comprise at least one layer of particles.

Control of the effective porosity of the secondary shell of particles may be effected by the selection of the size and distribution of said particles in the secondary shell.

The particles of the secondary shell may be in the micron size range. The particles of the secondary shell may have a particle size in the range selected from the group consisting of about 0.01 micron to about 100 microns, about 0.01 micron to about 75 microns, about 0.01 micron to about 50 microns, about 0.01 micron to about 25 microns, about 0.02 micron to about 100 microns, about 0.03 micron to about 100 microns, about 0.04 micron to about 100 microns and about 0.05 micron to about 100 microns. Preferably, the particles of the secondary shell have a size in the range of 0.05 micron to 25 microns.

The particles need not be uniformly dimensioned particles but may comprise of solid particles, hollow particles, microcapsules, or blends of particles of various types and sizes.

The particles may be affinity-treated to make them enhance their hydrophobicity or hydrophilicity. Surfaces of the particles may be treated with an affinity-treating agent so as to enhance the hydrophobicity or hydrophilicity of the particles. Examples of affinity-treating agents comprise at least one of the materials selected from the group comprising compounds with active groups on metals/metalloids, monometallic, monometalloid compounds, dimetallic (having two different metal/metalloid atoms, bimetallic (having two of the same metal/metalloid atoms in the compound), heterometallic (having one metal and one metalloid atom in the same compound), dimetalloid and bi-metalloid compounds, organic silanes and mixtures thereof. For example, by treating the particles with one of the compounds described hereinabove, the hydrophobicity of the particles may be changed to hydrophilicity, and therefore the particles may have a higher affinity to water. For example, where the hydrophobic particles comprise fumed silica, further chemical or electrochemical treatment may be used to form fumed silica particles having non-fumed reactive sites or non-fumed non-reactive sites that add to the hydrophobicity of a surface of the hydrophobic particles. Any treatment(s) that enable the particles to have a surface hydrophobicity or hydrophilicity as described above for the practice of the present invention will be suitable for use herein. The particles may comprise of epoxy resins, silicone resins, thermosetting polymers, thermoplastic polymers or elastomers.

The primary shell of liquid is encapsulated within the secondary shell of particles. The capsule may be easily transported without leakage or release of the encapsulated liquid, yet may be broken apart to release the encapsulated liquid. This secondary shell of particles may be disrupted by pressure and abrasion to release the encapsulated liquid.

In one embodiment, the liquid of the primary shell is aqueous. The aqueous medium may comprise aqueous solutions, aqueous dispersions, or aqueous emulsions. In one preferred embodiment, the liquid is water. The primary shell encapsulating the solid core may comprise at least one layer.

In one embodiment, the liquid of the primary shell comprises an anti-oxidant agent that inhibits or prevents oxidation of the material of the solid core. The anti-oxidant may be a phosphoric acid precursor. The phosphoric acid precursor may be phosphate ion donor.

In yet another embodiment, the phosphate ion donor is a metal phosphate complex. The metal phosphate complex may be selected from the group consisting of Group IA metals, Group IIA metals and Group IIIA metals. The metal phosphate complex may be selected from the group consisting of lithium phosphate, sodium phosphate, potassium phosphate, magnesium phosphate, calcium phosphate and aluminum phosphate.

The volume ratio of the liquid coating to the solid core is about 1:130 to 2:13. In one embodiment, the volume ratio of the liquid coating to the solid core is 1:13. The solid core may have a size in the range selected from the group consisting of about 0.1 micron to 1000 microns, about 10 micron to 800 microns, about 10 micron to 600 microns, about 10 micron to 400 microns, about 10 micron to 200 microns, about 15 micron to 1000 microns, about 20 micron to 1000 microns, about 25 micron to 1000 microns, about 30 micron to 1000 microns. Preferably, the solid core has a size in the range of 70 micron to 400 microns size range.

The solid core may be affinity-treated to enhance their hydrophobicity or hydrophilicity. Surfaces of the solid core may be treated with an affinity-treating agent so as to enhance the hydrophobicity or hydrophilicity of the particles. Examples of affinity-treating agents may be at least one of the materials selected from the group comprising compounds with active groups on metals/metalloids, monometallic, monometalloid compounds, dimetallic (having two different metal/metalloid atoms, bimetallic (having two of the same metal/metalloid atoms in the compound), heterometallic (having one metal and one metalloid atom in the same compound), dimetalloid and bi-metalloid compounds, and mixtures thereof. For example, by treating the solid core with least one of the materials selected described above, the hydrophilicity of the solid core may be enhanced, and therefore the solid core has a higher affinity to water.

In one embodiment, the solid core comprises a magnetic material. In another embodiment, the magnetic material of the solid core is a rare earth magnetic material. In one embodiment, the particles of the secondary shell are comprised of a magnetic material. In another embodiment, the magnetic material of the secondary shell comprises a rare earth magnetic material.

The rare earth magnetic material is one or more of light rare earth elements such as lanthanum (La), cerium (Ce), praseodymium, (Pr), neodymium (Nd), promethium (Pm), samarium (Sm), europium (Eu), and gadolinium (Gd) and combinations thereof. In a preferred embodiment, the rare earth magnetic material is an element selected from the group consisting of Neodymium, Praseodymium, Lanthanum, Cerium, and Samarium. More preferably, the rare earth magnetic material is Neodymium. In another embodiment, the magnetic material of this invention does not contain, except for unavoidable impurities, any heavy rare earth element such as terbium (Tb), dysprosium (Dy), holmium (Ho), erbium (Er), thulium (Tm), ytterbium (Yb) and lutetium (Lu).

Advantageously, the disclosed capsule is more resistant to external pressure in that the capsules may be handled as solid particles without rupture of the secondary shell to release the liquid primary shell, without at least a significant pressure being applied to the secondary shell. Accordingly, the capsules can be easily transported without rupture of the secondary shell and release of the primary liquid shell. However, if the capsules are subjected to a significant compressive force, such as during a compressive molding step, the secondary shell may rupture and release the primary liquid shell.

The shape of the microcapsules may be substantially circular, oval-shaped, square-shaped, trapezoidal-shaped or rectangular. In one embodiment, the shape of the capsule may be generally spherical. Hence, when referring to the diameter of the microcapsule, this may be interpreted to as referring to the equivalent diameter of the microcapsule, as appropriate, depending on the shape of the microcapsule. In other embodiments, the shape of the microcapsule may not be defined, that is, the microcapsule may have an irregular shape.

The capsules may have a size in the micron size range. The capsules may have a size in the range selected from the group consisting of about 10 micron to 1000 microns, about 10 micron to 800 microns, about 10 micron to 600 microns, about 10 micron to 400 microns, about 10 micron to 200 microns, about 15 micron to 1000 microns, about 20 micron to 1000 microns, about 25 micron to 1000 microns, about 30 micron to 1000 microns. Preferably, the capsules have a size in the range of 25 micron to 400 microns size range.

The capsules may be admixed or blended with microcapsules. It is also desirable to have non-encapsulated particles admixed with the encapsulated particles into a multi-particulate system.

Microcapsules disclosed in the present invention may be manufactured by mixing a liquid with a first population of solid core particles and a second population of fine particles.

In one embodiment, one of the second population of fine particles or the liquid is hydrophobic while the other of the respective second population of fine particles or the liquid is hydrophilic and the solid core particles are hydrophobic or hydrophilic.

In another embodiment, the first population of solid core particles is mixed with the liquid prior to mixing with the second population of fine particles. The mixing step may be carried out via mechanical stirring, V-blending process or rotated bed process. A preferred mixing step is effected by a rotated bed process. The mixing step uniformly distributes the first population of solid core particles throughout the liquid. The mixing step in the disclosed process may be carried out at an energy mixing rate of from 0.00005 to 5.0 kg $m^2$ $sec^{-1}$. The mixing step in the disclosed process may be carried out at a rotation speed of 30 to 50 revolutions per minute.

The relative volume amounts of core particles to fine particles may be in the range of 100:5 to 100:40. In one embodiment, the relative volume amounts of core particles to liquid to fine particles are 100:1:10. In another embodiment, the relative volume amounts of core particles to liquid to fine particles are 100:1:20. Prior to said mixing step, the disclosed process may comprise subjecting the second population of fine particles to surface treatment. Advantageously, the hydrophobicity or hydrophilicity of the surface of particles may be adjusted in accordance with the surface treatment. One method of surface-treatment is mixing the second population of fine particles with at least one of the materials selected from the group comprising compounds with active groups on metals/metalloids, monometallic, monometalloid compounds, dimetallic (having two different metal/metalloid atoms, bimetallic (having two of the same metal/metalloid atoms in the compound), heterometallic (having one metal and one metalloid atom in the same compound), dimetalloid and bi-metalloid compounds, and mixtures thereof. Mixtures and blends of the compounds described herein provide unique capabilities for uniformly distributing different properties over a surface, or balancing (averaging) properties over the surface.

A process for the manufacture of a magnetic body, the process comprising the step of compacting a mass of capsules to form the magnetic body, each capsule comprising a solid magnetic core, a primary shell of liquid encapsulating the solid core that comprises an anti-oxidant agent therein that inhibits or prevents oxidation of the magnetic core, and a secondary shell of particles encapsulating the primary shell, wherein one of the primary shell or secondary shell is hydrophobic while the other of the respective primary shell or secondary is hydrophilic, and wherein said compacting ruptures said secondary shell to release the liquid of the primary shell.

The secondary shell of particles may comprise of a magnetic material. By using a magnetic material for the secondary shells, the magnetic strength of the magnetic body may be enhanced. The magnetic core may be encapsulated by a secondary shell that is configured to rupture during compaction of the capsule. The secondary shell may be made from a material that can readily rupture under pressure during the compacting step in order to release the liquid contained therein.

During compaction, the liquid may be contacted with the exposed fresh surfaces that occurred as the magnetic core broke or fractured due to the pressure used during compaction. Hence, in-situ passivation occurred during the compaction step as the liquid contacted the exposed fresh surfaces of the magnetic core. By using a liquid that can move freely through the magnetic core, the fresh surfaces can be completely passivated so that the entire magnetic core can resist oxidation due to the presence of the protective anti-oxidant layer. In addition, the magnetic body formed from the disclosed process may not succumb to oxidation even at high temperatures and hence may not be in need of further anti-oxidative treatments.

In FIG. 1, there is provided a capsule 100 which according to a disclosed embodiment, has a solid core in the form of the core 2 which is made of rare earth magnetic material, a primary shell in the form of liquid shell 4, which liquid contains an anti-oxidant agent and a secondary shell in the form of shell 6, which is formed of an agglomerated mass of rare earth magnetic particles. The shell 6 consists of particles of varying sizes that can include but are not limited to those depicted by reference numerals 8, 10 and 12. The liquid shell 4 is hydrophilic while the shell 6 is hydrophobic. The core 2 is also hydrophilic.

EXAMPLES

Non-limiting examples of the invention and a comparative example will be further described in greater detail by reference to specific Examples, which should not be construed as in any way limiting the scope of the invention.

In the following Examples, unless stated otherwise, the magnetic material powder used was commercially available under the trade name MQFP® (which is a $Nd_2Fe_{14}B$ magnetic powder), MQP® (which is a $Nd_2Fe_{14}B$ magnetic powder), MQP-AA4® (which is a $Nd_2FeB$ magnetic powder) and MQLP-AA4® (which is a $Nd_2FeB$ magnetic powder) from Magnequench, Inc. of Singapore, and under the trade name MQTJ® (which is a $Nd_2Fe_{14}B$ magnetic powder) from Magnequench (Tianjin) Co. Ltd, China.

Example 1

Preparation of Microcapsules

Step 1: Preparation of Secondary Shell for Microcapsules.

25 grams of phosphoric acid is first dissolved in 90 ml of acetone to form a solution. Next, 500 grams of MQFP® (which is a $Nd_2Fe_{14}B$ magnetic powder) is poured into the solution. The mixture is heated at 85° C. and stirred with a mechanical stirrer until acetone is evaporated completely. The powders are then air-dried in a fume hood overnight. After that the powders are sieved by a 400 mesh sieve to remove +38 micrometer powders. The remaining powders are ready for silane treatment. 3.75 grams of 1H,1H,2H,2H-Perfluorodecyltriethoxysilane (Sigma Aldrich) is dissolved in 150 ml hexane to form another solution. 500 grams of pretreated MQFP® (which is a $Nd_2Fe_{14}B$ magnetic powder) is poured into the solution. The mixture is heated at 85° C. and stirred with a mechanical stirrer until hexane is evaporated completely. The powders are then air-dried in a fume hood overnight. Hydrophobic MQFP® (which is a $Nd_2Fe_{14}B$ magnetic powder) is obtained.

Step 2: Making Microcapsules.

11 grams of liquid comprising glycerol and water (mass ratio of 5:6) is poured into a plastic bottle. Next, 500 grams of MQLP-AA 4® (which is a $Nd_2FeB$ magnetic powder) is added to the same bottle. The mixture is then subjected to vigorous shaking until none of the mixture adheres to the inner surface of the bottle. The mixture is then mechanically stirred to ensure uniformity in the powders produced. Following this, the mixture is further blended in a V-blender at 60 rotations per minute for 5 minutes. After that, 100 grams of hydrophobic MQFP® (which is a $Nd_2Fe_{14}B$ magnetic powder) is added to the mixture in the bottle. The mixture is further blended at 60 rotations per minute for 5 minutes. The mixture is then sieved with a 60 mesh sieve before they are sealed and stored in a plastic bottle.

A schematic diagram of a capsule is shown in FIG. 1.

Example 2

Making Magnets Using Two Parts Compound

I. Compound Preparation:

Step 1: Microcapsules Obtained from Example 1 to be Served Directly as Part A for the Compound.

Step 2: Preparation of Part B for the Compound:

100 grams of dried Aluminum Phosphate (AP) (Monobasic,Fluka, Sigama Aldrich) is dissolved in 500 ml of Isopropyl alcohol (IPA). After AP/IPA is poured into a tank, 2.5 kilograms of MQLP-AA4® (which is a $Nd_2FeB$ magnetic powder) is placed in the same tank. Coating begins at a temperature of 85° C. by Ross Mixer (Ross Mixing, Inc). The treated powders are collected and placed in an open space for 3 days. The treated powders are sieved through a 60 mesh after they have been dried. The −60 mesh powders are collected and are ready for silane treatment.

2 grams of 1H,1H,2H,2H-Perfluorodecyltriethoxysilane (Sigma Aldrich) is dissolved in 150 ml of hexane to form yet another solution. Next, 500 grams of pre-treated MQLP-AA 4® (which is a $Nd_2FeB$ magnetic powder) is poured into the solution. The mixture is heated at 85° C. and stirred with a mechanical stirrer until the hexane is evaporated completely. The powders are then air-dried in a fume hood overnight. The treated powders are to be served as Part B for the compound.

Prior to the manufacture of a magnetic body, Part A and Part B (mass ratio of 6:5) are mixed in a V-blender with 30 rotations per minute for 5 minutes to form a compound for magnet making.

II. Making a Magnet:

2.83 grams of MQLP-AA4® (which is a $Nd_2FeB$ magnetic powder) are placed into the cavity of a cold pressing mould. The pressing pressure of the Wabash pressing machine is set to 5.5 ton and the press button is triggered to begin the manufacturing process of the magnetic body. When the pressing pressure reaches 5.5 ton, the press button is held for 5 seconds after which, the formed magnetic body is ejected.

Figure 2:
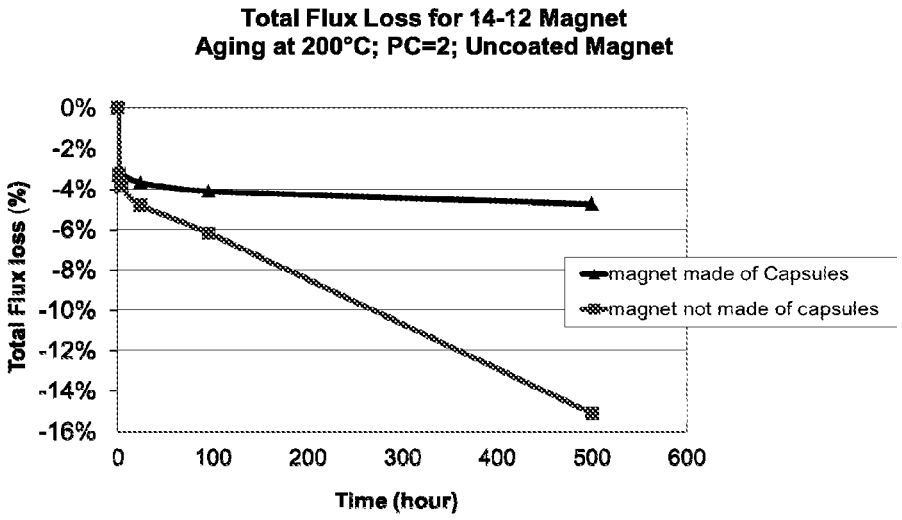
FIG. 2 is a graph of total flux loss (%) for the magnet with microcapsule and an magnet without microcapsule, versus time (hour).

In order to determine total flux loss of the magnetic body made of capsules as a function of exposure time, the magnetic body made of capsules was cured in an oven set at 200° C. for a test time duration of 500 hours. The results from this experiment are demonstrated in FIG. 2. These results show that the magnet made of capsules suffered a total flux loss of less than 5% by the $500^{th}$ hour.

Comparative Example 2.83 grams of MQLP-AA4 are placed into the cavity of a cold pressing mould. The pressing pressure of the Wabash pressing machine is set to 5.5 ton and the press button is triggered to begin the manufacturing process of the magnetic body. When the pressing pressure reaches 5.5 ton, the press button is held for 5 seconds after which, the formed magnetic body is ejected.

In order to determine total flux loss of the magnetic body made of capsules as a function of exposure time, the magnetic body made of capsules was cured in an oven set at 200° C. for a test time duration of 500 hours. The results from this experiment are demonstrated in FIG. 2. These results show that the magnet made without capsules suffered a total flux loss of more than 15% by the $500^{th}$ hour.

It should be appreciated that the encapsulation system disclosed herein is a simple yet improved method for the delivery of anti-oxidants during the manufacture of a magnetic body which ultimately aims to maximise the durability and life of the magnet produced.

Advantageously, the disclosed encapsulation system involving a capsule comprising a solid magnetic core, a primary shell of liquid encapsulating the solid core that contains medium which is able to activate an anti-oxidant agent therein that inhibits or prevents oxidation of the magnetic core, and a secondary shell of particles encapsulating the primary shell, and wherein the said compaction step ruptures said secondary shell to release the liquid of the primary shell; allows a protective oxidative layer to be dispersed uniformly over both the surface of each magnetic particle and newly created surfaces including localised spots contained within the microfractures of the magnetic particles during the magnet manufacturing process. Therefore, the anti-oxidant can be activated easily and be evenly distributed throughout the entire magnetic body. In addition, the magnet formed from a process involving the compaction of the disclosed capsules may not succumb to oxidation even at high temperatures and hence may not be in need of further anti-oxidative treatments.

Advantageously, during the formation of the said solid core of the disclosed capsule, there is no need to atomise/spray water into droplets to form the core. This is particularly important when the liquid (e.g. hydrophobic solvent) is flammable and spraying or atomizing of such a liquid causes a safety hazard. In the manufacture of the said solid core, the liquid containing the anti-oxidant is simply mixed with the solid core particles by stirring followed by mixing a hydrophobic particle with the above mixture by a V-blending process at a low rotation speed of 30-50 rotations per minute. Thus, the process for manufacturing the disclosed capsule does not require complex equipment and enhances the commercial and industrial applicability of the manufacturing process without compromising productivity and cost-effectiveness.

Advantageously, the disclosed capsule is more resistant to external pressure compared water droplets/beads which are considered to be too fragile for purpose of the present invention.

More advantageously, in the disclosed capsule, there is flexibility in the choice of materials used in the manufacture of the primary liquid shell and the secondary shell made of solid particles in order to achieve various desired properties. For example, in this invention, the fine NdFeB particles are not only used to form the secondary shell; but due to their magnetic properties, they also contribute to the magnetic strength of the magnets manufactured.

Finally, the disclosed capsule can be used in the manufacture of a rare earth magnetic body of superior durability with improved anti-oxidative properties and a prolonged magnetic life.

It will be apparent that various other modifications and adaptations of the invention will be apparent to the person skilled in the art after reading the foregoing disclosure without departing from the spirit and scope of the invention and it is intended that all such modifications and adaptations come within the scope of the appended claims.

The invention claimed is:

1. A capsule comprising a solid core, a primary shell of liquid encapsulating the solid core and a secondary shell of particles encapsulating the primary shell, wherein the primary and secondary shells are generally repulsive to each other.

2. The capsule as claimed in claim 1, wherein the secondary shell is liquidphobic so that said primary and secondary shells are generally repulsive to each other.

3. The capsule as claimed in claim 2, wherein the primary shell is hydrophilic and the secondary shell is hydrophobic.

4. The capsule as claimed in claim 2, wherein the solid core is hydrophilic.

5. The capsule as claimed in claim 1, wherein the particles of the secondary shell have a size in a range of 0.05 micron to 25 microns.

6. The capsule as claimed in claim 1, having a size in a range of 25 micron to 400 microns.

7. The capsule as claimed in claim 1, wherein the liquid of the primary shell is aqueous.

8. The capsule as claimed in claim 1, wherein the liquid of the primary shell comprises an anti-oxidant agent that inhibits or prevents oxidation of the material of the solid core.

9. The capsule as claimed in claim 8, wherein the anti-oxidant agent is a phosphate ion donor, wherein the phosphate ion donor is a metal phosphate complex.

10. The capsule as claimed in claim 9, wherein the metal of the metal phosphate complex is selected from the group consisting of Group IA metals, Group IIA metals and Group IIIA metals.

11. The capsule as claimed in claim 1, wherein the solid core is comprised of a magnetic material, wherein the magnetic material of the solid core is a rare earth magnetic material.

12. The capsule as claimed in claim 1, wherein the particles of the secondary shell are comprised of a magnetic material.

13. The capsule as claimed in claim 12, wherein the magnetic material of the secondary shell are comprised of a rare earth magnetic material.

14. The capsule as claimed in claim 12, wherein the rare earth magnetic material is an element selected from the group consisting of Neodymium, Praseodymium, Lanthanum, Cerium, and Samarium.

15. The capsule as claimed in claim 1, wherein the solid core has a size in the range of 0.1 micron to 1000 microns.

16. The capsule as claimed in claim 1, wherein the solid core has a size in the range of 70 micron to 400 microns.

17. The capsule as claimed in claim 1, wherein the shape of the capsule is generally spherical.

18. A process for the manufacture of capsules comprising the steps of:

providing a first population of solid core particles and a second population of fine particles that are smaller than the solid core particles of the first population; and mixing a liquid with the first population and the second population to thereby form capsules which comprise the solid core, a primary shell of the liquid encapsulating the solid core and a secondary shell of the fine particles encapsulating the primary shell, wherein the primary and secondary shells are generally repulsive to each other.

19. The process as claimed in claim 18, wherein one of the second population of fine particles or the liquid is hydrophobic while the other of the respective second population of fine particles or the liquid is hydrophilic and wherein the solid core particles are hydrophobic or hydrophilic.

20. A process for the manufacture of a magnetic body, the process comprising the step of compacting a mass of capsules to form the magnetic body, each capsule comprising a solid magnetic core, a primary shell of liquid encapsulating the solid core that comprises an anti-oxidant agent therein that inhibits or prevents oxidation of the magnetic core, and a secondary shell of particles encapsulating the primary shell, wherein one of the primary shell or secondary shell is hydrophobic while the other of the respective primary shell or secondary is hydrophilic, and wherein said compacting ruptures said secondary shell to release the liquid of the primary shell.

* * * * *